United States Patent [19]

Akatsuka et al.

[11] Patent Number: 4,602,600

[45] Date of Patent: Jul. 29, 1986

[54] METHOD OF CONTROLLING DIESEL ENGINE

[75] Inventors: Takao Akatsuka, Aichi; Masaomi Nagase, Toyota; Hideo Miyagi; Takahide Kawamura, both of Okazaki, all of Japan

[73] Assignee: Toyota Jidosha Kabushiki Kaisha, Aichi, Japan

[21] Appl. No.: 697,432

[22] Filed: Feb. 1, 1985

Related U.S. Application Data

[63] Continuation of Ser. No. 380,834, May 21, 1982, abandoned.

[30] Foreign Application Priority Data

Jul. 6, 1981 [JP] Japan ..... 56-105300

[51] Int. Cl.[4] ..... F02M 39/00

[52] U.S. Cl. ..... 123/198 D; 123/357; 123/479; 123/179 L

[58] Field of Search ..... 123/198 D, 198 DB, 479, 123/357, 179 L, 503, 358–359

[56] References Cited

U.S. PATENT DOCUMENTS

| | | | |
|---|---|---|---|
| 3,834,361 | 9/1974 | Keely | 123/479 |
| 3,993,038 | 12/1976 | Alt | 123/198 DB |
| 4,023,358 | 5/1977 | Maurer | 123/198 DB |
| 4,192,279 | 5/1980 | Maisch | 123/198 DB |
| 4,312,310 | 1/1982 | Chiuilo | 123/198 DB |
| 4,395,905 | 8/1983 | Fujimori | 123/357 |

FOREIGN PATENT DOCUMENTS

| | | | |
|---|---|---|---|
| 0075928 | 6/1981 | Japan | 123/357 |

*Primary Examiner*—Carl Stuart Miller
*Attorney, Agent, or Firm*—Parkhurst & Oliff

[57] ABSTRACT

Electric current supply to an actuator is ON-OFF controlled in such a manner that fuel supply quantity is made to be zero on condition that an engine rotation speed reaches a rotation speed less than a predetermined one in a low rotation region and a starter switch is turned OFF, whereby overrun of an engine and reckless run of a vehicle are prevented when a rotation sensor is in an abnormal condition.

6 Claims, 8 Drawing Figures

METHOD OF CONTROLLING DIESEL ENGINE

This is a division of application Ser. No. 380,834, filed May 21, 1982, now abandoned.

BACKGROUND OF THE INVENTION

1. Field of the Invention

The present invention relates to method of controlling diesel engine for coping with an abnormality of an engine rotation sensor.

2. Description of the Prior Art

In controlling a fuel injection rate of a diesel engine through the electronic control, the condition of the engine and the condition of load, including the rotational speed of the engine, the opening of an accelerator and the engine water temperature and the like are detected by various sensors, a fuel injection rate is calculated from the results thus detected and a spill actuator (provided in a fuel injection pump) is controlled to select an actual fuel injection rate equalling to the calculated fuel injection rate.

As described above, in the electronic fuel injection control, the engine rotational speed is selected as one of the factors of control, and hence, when the engine rotation sensor is fallen into an abnormality, the fuel injection rate is always regarded as being based on the rotation speed of O. Because of this, the fuel injection rate should necessarily increase, with the result that there may occur an overrun of the engine, a reckless run of a vehicle or a damage of the engine.

SUMMARY OF THE INVENTION

The present invention has as its object the provision of method of controlling a diesel engine for preventing an engine overrun due to an occurrence of an abnormality in an engine rotation sensor.

The present invention contemplates that the presence of an abnormality in an engine rotation sensor is judged depending upon the establishment of a flag to an output signal of the engine rotation sensor and the establishment of a starter signal, and the fuel injection rate is controlled in accordance with the content of the judgement.

DETAILED DESCRIPTION OF THE INVENTION

Figure 1:
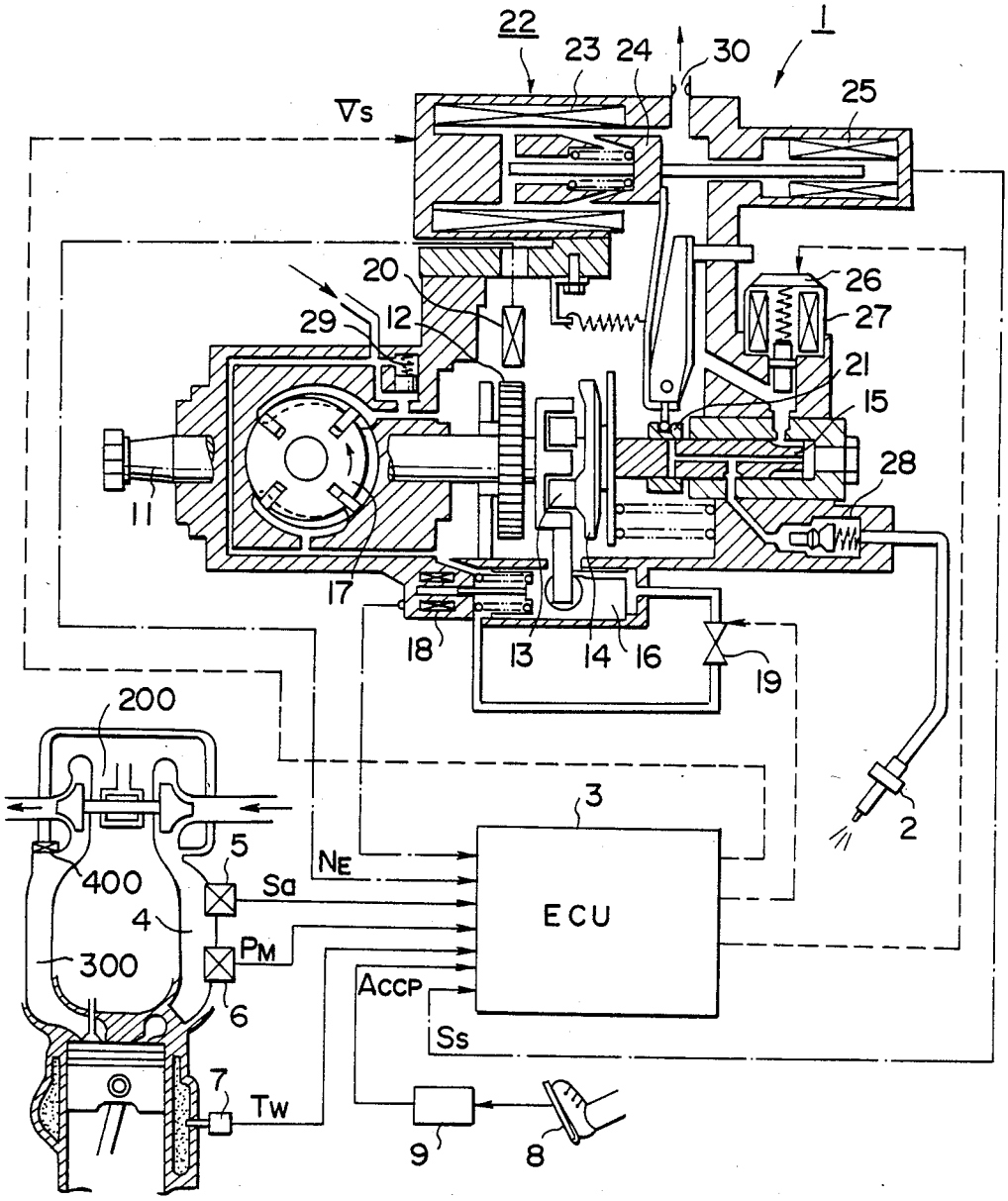
FIG. 1 is a block diagram showing one embodiment of the present invention.

FIG. 1 is a block diagram showing one embodiment of the present invention. A fuel injection pump 1 comprises: a drive shaft 11 driven by the engine; a gear 12 and a roller 13 provided at one end portion of the drive shaft 11; a cam plate 14 loosely coupled to the roller 13; a pump plunger 15 connected to the plate 14, for feeding fuel to injection nozzles 2 (only one of those nozzles is shown in the drawing) of the engine; a fuel pump 17 for feeding fuel to the injection nozzles 2 and a timer position 16; a timer position sensor 18 for electrically detecting the position of the timer piston 16; a timing control valve 19 for detecting the advance angle adjusted; an electromagnetic pickup sensor 20 for emitting pulse signals corresponding to the rotational speed of the gear 12; a spill ring 21 coupled onto the pump plunger 15, for adjusting the fuel injection rate to the nozzles; a linear solenoid 22 for driving the spill ring 21; a coil 23 constituting the linear solenoid 22 and a plunger 24 for driving the spill ring 21; a spill position sensor 25 for detecting a movement value of the plunger 24; a fuel control valve (hereinafter referred to as "FCV") 26 (constituted by an exciting coil 27 and a valve 28) for controlling the quantity of fuel to be fed to the pump plunger 15; delivery valves 28 for distributing fuel from the pump plunger 15 to the plurality of injection nozzles; and a regulating valve 29.

The cam plate 14 rotates and reciprocates in unison with the pump plunger 15. This reciprocation is caused as a cam plate 14 goes on the top of a roller 13 which is rotatable but fixed in the axial direction of the shaft 1. Rotation of the pump plunger 15 causes fuel to be fed to the respective nozzles. The fuel injection rate is adjusted such that the spill ring 21 is moved by the plunger 24 in the axial direction thereof, whereby the fuel supply to the nozzle 2 is adjusted. A surplus fuel in the pump is returned to the inlet side of the pump through an orifice 30.

On the other hand, on the side of the engine, a supercharger 200 relating to air intake and exhaust is connected to an intake manifold 4 and an exhaust manifold 300. A waste gate valve 400 is provided on the exhaust side of the supercharger 200, and the intake manifold 4 and the exhaust manifold 300 are communicated with each other through this waste gate valve 400. As well known, the supercharger comprising a turbine and a compressor is intended for that thermal energy contained in the exhaust gas is recovered by the turbine, and air compressed by the compressor is fed to a combustion chamber, thereby improving the power of the engine.

Control of the linear solenoid 22 and FCV 26 which have relation to control of fuel quantity is effected by an electronic control unit (hereinafter referred to as "ECU") 3. To do this, output signals of various sensors are taken in. More specifically, these output signals include an engine rotation signal $N_E$ from the electromagnetic pickup sensor 20, an output signal $S_S$ from the spill position sensor 25 and data on the engine (The timer position sensor 18 is used for timing control and has no relation to the present invention, so that description thereof will be omitted). The data on the engine include: an output signal $S_a$ from an intake air temperature sensor 5 provided on the intake manifold 4; an output signal $P_M$ from an intake air pressure sensor 6 also provided on the intake manifold 4; an output signal $S_W$ from a waste temperature sensor 7 for detecting the engine cooling water temperature and an output signal ACCP from an acceleration sensor 9 for detecting a depression value of an accelerator 8.

Figure 2:
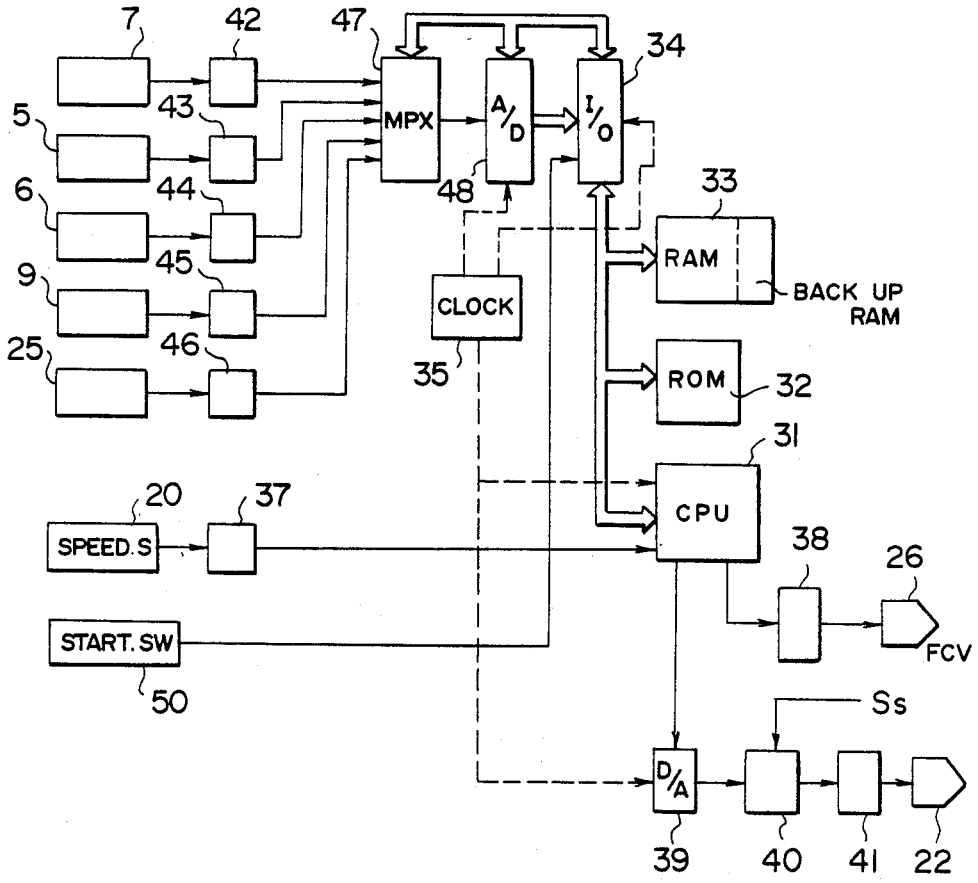
FIG. 2 is a detailed block diagram of a control unit 3 shown in FIG. 1.

FIG. 2 is a detailed block diagram of ECU 3 shown in FIG. 1, illustrating an embodiment in which a microcomputer is used as ECU 3.

Read Only Memory (hereinafter referred to as "ROM") 32 storing therein process programs for performing various processes in addition to a program to be described hereunder, a monitor program and the like, Random Access Memory (hereinafter referred to as "RAM") 33 temporarily storing contents of calculations, contents of outputs from the various sensors and the like and having a backup memory continuously storing contents of calculations, set values and the like during power-off condition, and an input/output (hereinafter referred to as "I/O") circuit 34 are connected through a bus line 36 to a central power unit (hereinafter referred to as "CPU") 31 as being the core, thereby constituting a microcomputer. Output components connected to and controlled by CPU 31 include the linear solenoid 22 and FCV 26 for controlling a fuel injection valve. FCV 26 is driven through a driving circuit 38, and the linear solenoid is driven through a D/A converter 39, a servo-amplifier 40 and a driving circuit 41 in the serial order as describe. I/O circuit 34 is intended for taking in outputs of the sensors and an output from a starter switch 50. A multiplexer (hereinafter referred to as "MPX") 47 takes in sequentially output signals (taken out through buffers 42, 43, 44, 45 and 46) from sensors (5, 6, 7, 9 and 25) or selects one of those output signals, and feeds the same to A/D converter 48 where the output signal or signals are converted into a digital signal or signals. A/D converter 48 feeds the digital signal or signals to I/O circuit 34. Then, I/O circuit 34 feeds data to the bus line 36. An output signal from the rotation detector (the electromagnetic pickup sensor) 20 for detecting the rotation speed $N_E$ of the engine is fed to a waveshape shaping circuit 37 for waveshape shaping. Then, waveshape shaping circuit 37 feeds the output signal to CPU 1. Further, a clock circuit 35 is provided for feeding clock pulse signals to CPU 1, I/O circuit 34, A/D converter 48 and D/A converter 39, respectively.

Now, the control of the fuel injection rate is effected by controlling the position of the spill ring 21 shown in FIG. 1 by the plunger 24. The injection timing can be desirably varied by controlling the oil pressure in the timer piston 16 by the timing control valve 19. The plunger 24 is driven by feeding an exciting current to the linear solenoid 22 of the actuator. The movement value of the plunger 24 can be set by the value of this exciting current, which is calculated by ECU 3 based on the engine condition signals such as the engine rotational speed signal $N_E$ from the rotation sensor 20, the output signal $T_W$ from the water temperature sensor 7, the output signal $P_M$ from the intake air pressure sensor 6. The value of exciting current fed to the linear solenoid 22 can be determined specifically in the following manner.

Figure 3:
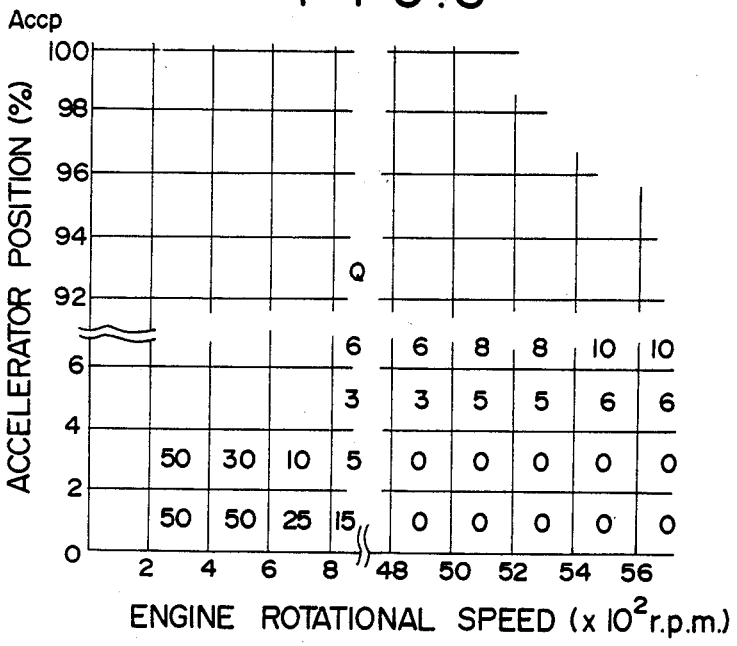
FIG. 3 is a view showing fuel injection rates set according to an engine rotational speed $N_E$ and accelerator openings ACCP.
Figure 4:
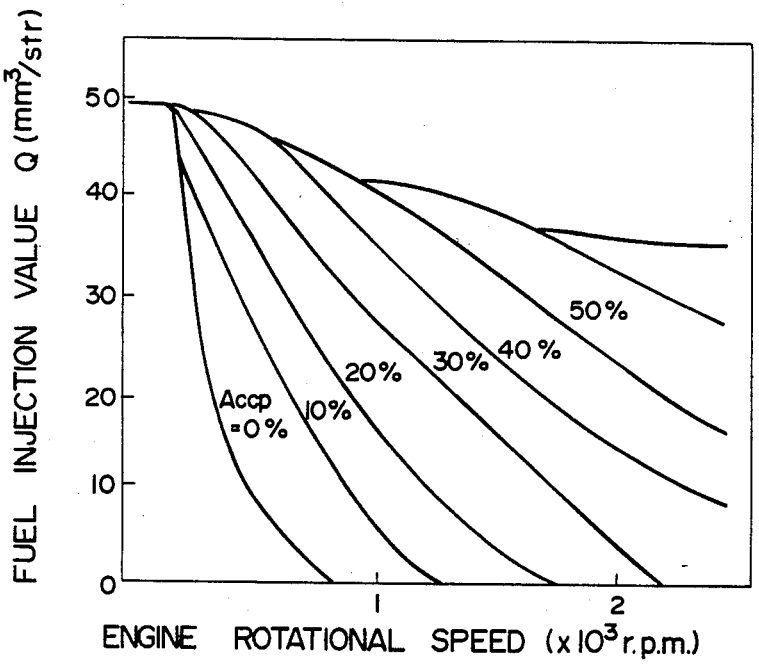
FIG. 4 is a view showing the fuel injection rates set against the engine rotational speed $N_E$ with an accelerator opening being fixed at predetermined values.

FIG. 3 is a view showing the fuel injection rates set according to engine rotational speeds $N_E$ and accelerator openings ACCP. In the drawing, the numerals indicate the fuel injection rates. Additionally, FIG. 4 shows the fuel injection rates set Q against the engine rotational speed $N_E$ with the accelerator openings being fixed at predetermined values. FIG. 4 is a rewritten FIG. 3. As apparent from FIG. 4, with the accelerator opening being fixed, the fuel injection rate Q decreases as the engine rotational speed $N_E$ increases.

Figure 5:
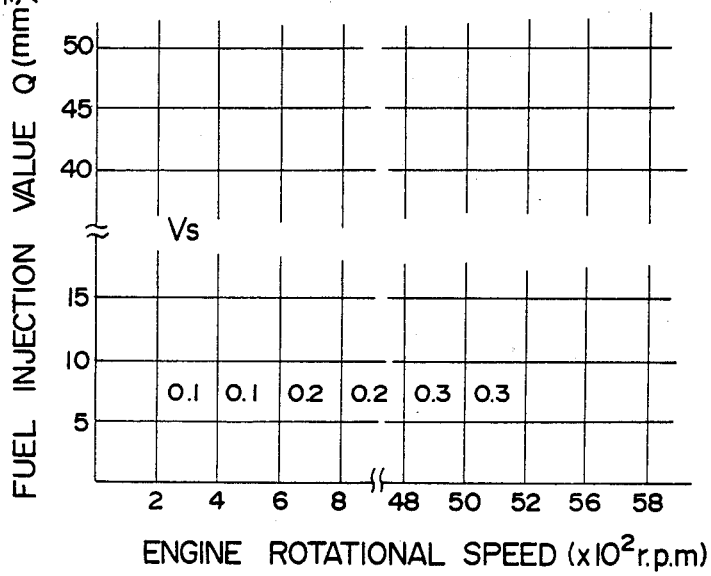
FIG. 5 is a view showing spill position command voltages set.

The spill position command voltage $V_S$ is sought through FIG. 5 based on the fuel injection rate Q obtained by satisfying the contents of FIG. 4 and the engine rotational speed $N_E$. The exciting current to be fed to the linear solenoid 22 should be controlled such that this spill position command voltage $V_S$ comes to be equal to the output signal $S_S$ from the spill position sensor 25.

Figure 6:
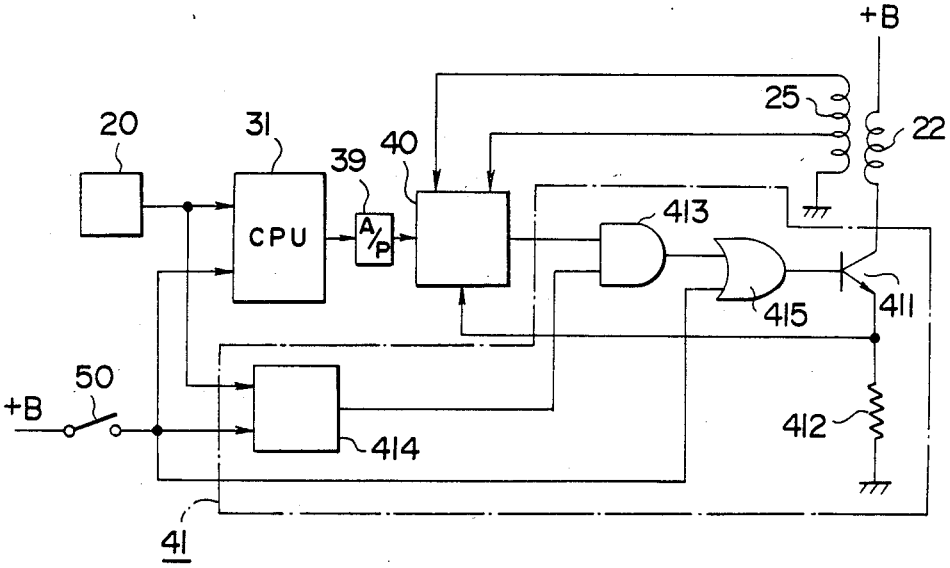
FIG. 6 is a detailed block diagram of a driving circuit 41 shown in FIG. 2.

FIG. 6 detailedly shows the driving circuit 41 for driving the linear solenoid 22. The output signal from the electromagnetic pickup sensor 20 is taken into RAM 33. CPU 31 calculates the spill position command voltage $V_S$ shown in FIG. 5 based on the output signal. This spill position command voltage $V_S$, upon being calculated to an analogue signal in D/A converter 39, is fed to the servo-amplifier 40. The servo-amplifier 40 seeks a deviation $\Delta V$ between the spill position command voltage $V_S$ and an output signal $S_S$ from the spill position sensor 25. On the other hand, a driving transistor 411 of the driving circuit 41 makes the linear solenoid 22 as a collector load and a feedback resistor 412 is connected to the emitter thereof. This voltage drop generated in this resistor 412 is fed to the servo-amplifier 40 as a feedback signal. An output signal from the servo-amplifier 40 is fed to one of input terminals of AND circuit 413. As an input signal to the other of input terminals of AND circuit 413 is used an output signal from a sensor signal discriminator circuit 414. The sensor signal discriminator circuit 414 receives as input signals an output signal from the electromagnetic pickup sensor 20 and an output signal from the starter switch 50, and emits an output signal while the electromagnetic pickup sensor 20 is normally operated. While an output signal is generated in the sensor signal discriminator circuit 414, an output signal is emitted from AND circuit 413 and applies a driving signal to the transistor 411 through OR circuit 415. Further, an output signal from the starter switch 50 is applied to OR circuit 415. OR circuit 415, even when no output signal is generated in AND circuit 413, emits an output signal and turns the transistor 411 ON when the starter switch is ON.

Figure 7:
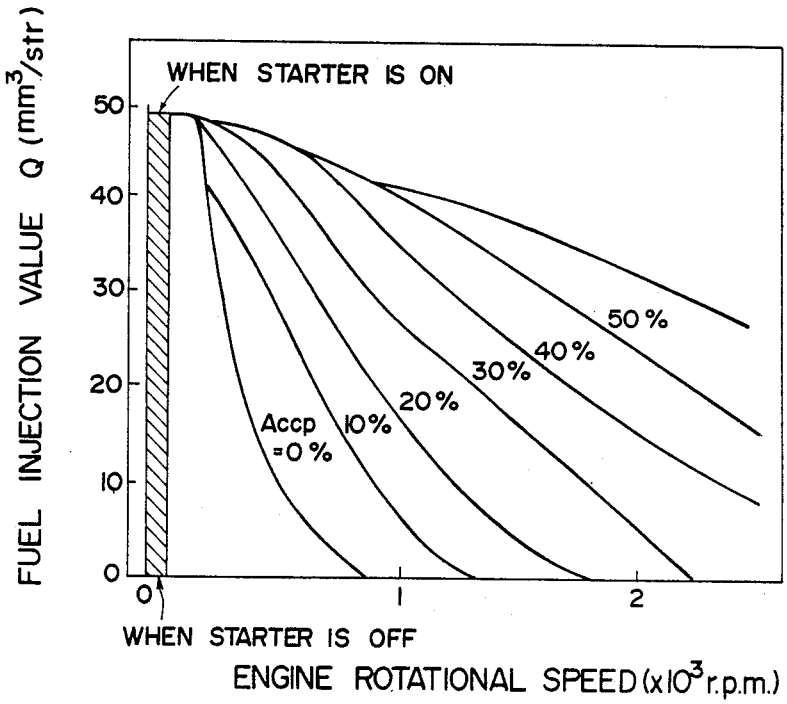
FIG. 7 is a view showing the characteristics of fuel injection according to the present invention.

When a signal from the electromagnetic pickup sensor (rotation sensor) 20 detects a condition of less than a predetermined rotation speed (a condition close to 0 rpm), the output level of the sensor signal discriminator circuit 414 comes to be of low level, and AND circuit 413 is turned OFF. During rotation of the engine, an output signal from the starter switch 50 of low level, whereby no output signal is generated in OR circuit 415, the transistor 411 is turned OFF and the current fed to a spill actuator is cut off. This operation will be specifically described with reference to FIG. 7. FIG. 7 illustrates the characteristics of the fuel injection rate against the rotation speed of the engine. A hatched region where the engine rotation speed is close to 0 rpm, is the region of operation of the sensor signal discriminator circuit 414, and, upon entering the hatched region, an output signal from the sensor signal discriminator circuit 414 is changed from the high level to the low level, e.g., from 50 ($mm^3$/str) to 0 ($mm^3$/str) in fuel quantity at once. By this, the engine is stopped in operation, whereby no reckless run of the vehicle and no overrun of the engine may occur. In addition, during starting of the engine, an output from the electromagnetic pickup sensor 20 may not be emitted. Therefore, an output signal from the starter switch is taken into the sensor signal discriminator circuit 414, wherweby the output signal from the circuit is prevented from falling into the low level. Namely, during rotation of the starter and after a predetermined period of time (This is a period of time required for the increase in the rotation speed of the engine, e.g., 0.5 SEC), a predetermined fuel injection value (50 $mm^3$/str in the example shown in FIG. 7) is supplied.

Figure 8:
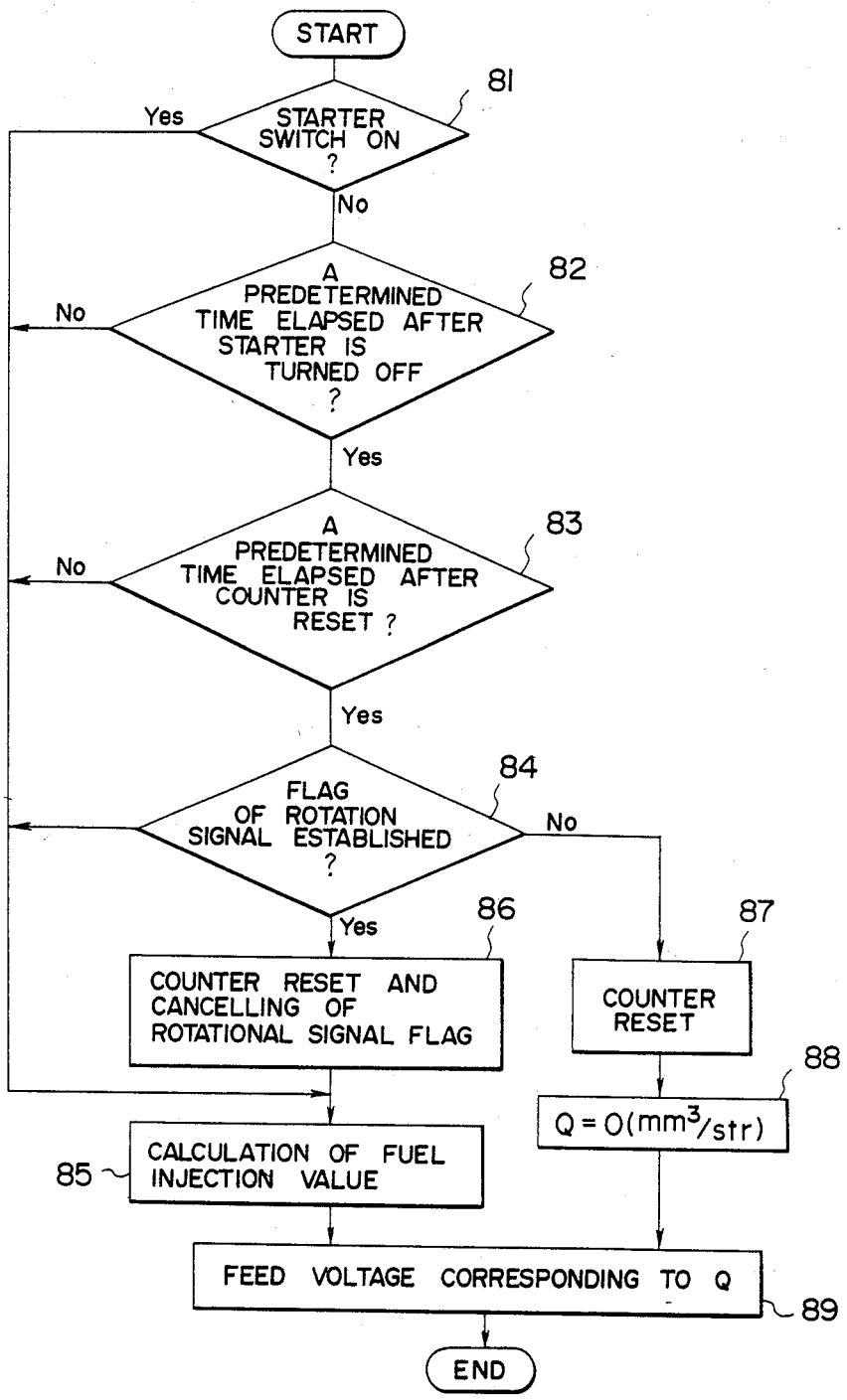
FIG. 8 is a process flow chart of the present invention.

FIG. 8 is a flow chart showing an example of detecting an abnormality in the rotation sensor by the control unit 3.

Firstly, in Step 81, judgement is made whether the starter switch in ON or OFF, and, if the starter switch 50 is ON, the process will be transferred to the calculation of the fuel injection rate in Step 85. If the starter switch 50 is OFF, the process will be transferred to Step 82, and, after the starter switch 50 is turned OFF, judgement will be made whether a predetermined period of time has elapsed or not. When the predetermined period of time has not elapsed, the process will be transferred to Step 85, but, when the predetermined period of time has elapsed, the process will be transferred to Step 83. In Step 83, after a counter for counting the elapsed period of time is reset, judgement will be made whether a predetermined period of time has elapsed or not. When the predetermined period of time has not elapsed, the process will be transferred to Step 85, but, when the predetermined period of time has elapsed, the process will be transferred to Step 84. In Step 84, judgement is to be made whether there exists a rotation signal flag established depending on whether an output signal from the electromagnetic pickup sensor 20 is present or not. When the flag is present, the process will be transferred to Step 86, where the counter will be reset and the aforesaid flag will be cancelled, and then, the process will be transferred to Step 85. On the other hand, when the flag is not present, the counter will be reset in Step 87, and subsequently, the process will be transferred to Step 88, where the fuel injection rate will be set to $Q=0$ ($mm^3$/str). As shown in FIG. 7, in Step 85, calculation of the fuel injection rate Q corresponding to the accelerator opening ACCP, and then, the process will be transferred to Step 89. Similarly, upon completion of the process in Step 88, the process will be transferred to Step 89, the spill position command voltage $V_s$ corresponding to a fuel injection rate Q calculated or set in some step will be emitted.

The process shown in FIG. 8 is effected periodically or irregularly, i.e., when an interruption takes place, and, upon completion of Step 89, the process may be returned to the initial step. However, in the case of the process effected by a microcomputer, since a plurality of types of processes are carried out, these processes are performed in series, and thereafter, the process shown in FIG. 8 will be carried out.

What is claimed is:

1. A method for controlling a diesel engine wherein a fuel injection rate of fuel injection pump is electronically determined in accordance with an engine rotational speed detected by an engine rotational speed sensor means and an amount of depression of an accelerator pedal, said engine rotational speed sensor means generating pulses proportional to the engine rotational speed, the fuel injection rate increasing as the engine rotational speed decreases under a fixed amount of depression of the accelerator pedal, and the fuel injection rate increasing as the amount of depression of the accelerator pedal increases, said method comprising the steps of:

(a) when an off state of a starter for the diesel engine is detected;

monitoring the generation of said pulses to detect a failure of said engine rotational speed sensor means, said failure being detected when no pulse is generated after a first predetermined time has elapsed, the first predetermined time commencing when the off state of the starter is detected;

generating an abnormal signal indicative of said failure of said engine rotational speed sensor means;

once the abnormal signal is generated and the off state of the starter is detected, determining said fuel injection rate at zero regardless of the amount of the depression of said accelerator pedal; and (b) when an on state of said starter is detected;

determining said fuel injection rate at a predetermined value of injection for a second predetermined period of time regardless of said engine rotational speed and said amount of depression of the accelerator pedal.

2. A method for controlling of a diesel engine as set forth in claim 1, wherein said second predetermined period of time is determined for increasing the rotational speed of the engine.

3. A method for controlling a diesel engine wherein a fuel injection rate is electronically determined in accordance with an engine rotational speed detected by an engine rotational speed sensor means and an amount of depression of an accelerator pedal, the engine rotational speed sensor means generating pulses directly proportional to the engine rotational speed, said method comprising the steps of:

feeding fuel to the diesel engine at a fuel injection rate;

adjusting the fuel injection rate in response to the engine rotational speed and the amount of depression of the accelerator pedal, the fuel injection rate increasing as the engine rotational speed decreases for a fixed amount of depression of the accelerator pedal, and the fuel injection rate increasing as the amount of depression of the accelerator pedal increases;

(a) when an off state of a starter for the diesel engine is detected;

monitoring the generation of said pulses to detect a failure of said engine rotational speed sensor means, said failure being detected when no pulse is generated after a first predetermined time has elapsed, the first predetermined time commencing when the off state of the starter is detected;

generating an abnormal signal indicative of said failure of said engine rotational speed sensor means; and once the abnormal signal is generated and the off state of the starter is detected, determining said fuel injection rate at zero regardless of the amount of the depression of said accelerator pedal; and (b) when an on state of the starter for the diesel engine is detected;

immediately determining said fuel injection rate at a predetermined value of injection for a second predetermined period of time regardless of said engine rotational speed and said amount of depression of the accelerator pedal.

4. A method for controlling of a diesel engine as set forth in claim 3, wherein said second predetermined period of time is determined for increasing the rotational speed of the engine.

5. A method for controlling a diesel engine wherein a fuel injection rate of a fuel injection pump is electronically determined in accordance with an engine rotational speed detected by an engine rotational speed sensor means and an amount of depression of an accelerator pedal, said engine rotational speed sensor means generating pulses proportional to the engine rotational speed, the fuel injection rate increasing as the engine rotational speed decreases under a fixed amount of depression of the accelerator pedal, and the fuel injection rate increasing as the amount of depression of the accelerator pedal increases, said method comprising the steps of:

detecting an off state of a starter for the diesel engine;

monitoring the generation of said pulses to detect a failure of said engine rotational speed sensor means, said failure being detected when no pulse is generated after a predetermined time has been elapsed, the predetermined time commencing when the off state of the starter is detected;

generating an abnormal signal indicative of said failure of said engine rotational speed sensor means; and once the abnormal signal is generated and the off state of the starter are detected, determining said fuel injection rate at zero regardless of the amount of the depression of said accelerator pedal.

6. A method for controlling a diesel engine wherein a fuel injection rate is electronically determined in accordance with an engine rotational speed detected by an engine rotational speed sensor means and an amount of depression of an accelerator pedal, the engine rotational speed sensor means generating pulses directly proportional to the engine rotational speed, said method comprising the steps of:

feeding fuel to the diesel engine at a fuel injection rate;

adjusting the fuel injection rate in response to the engine rotational speed and the amount of depression of the accelerator pedal, the fuel injection rate increasing as the engine rotational speed decreases for a fixed amount of depression of the accelerator pedal, and the fuel injection rate increasing as the amount of depression of the accelerator pedal increases;

detecting an off state of a starter for the diesel engine;

monitoring the generation of said pulses to detect a failure of said engine rotational speed sensor means, said failure being detected when no pulse is generated after a predetermined time has elapsed, the predetermined time commencing when the off state of the starter is detected;

generating an abnormal signal indicative of said failure of said engine rotational speed sensor means; and once the abnormal signal is generated and the off state of the starter are detected, determining said fuel injection rate at zero regardless of the amount of the depression of said accelerator pedal.

* * * * *